US009690236B1

(12) United States Patent
Miyakoshi

(10) Patent No.: US 9,690,236 B1
(45) Date of Patent: Jun. 27, 2017

(54) TRANSFER DEVICE AND IMAGE FORMING APPARATUS

(71) Applicant: FUJI XEROX CO., LTD., Tokyo (JP)

(72) Inventor: Yukiko Miyakoshi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/084,612

(22) Filed: Mar. 30, 2016

(30) Foreign Application Priority Data

Dec. 18, 2015 (JP) ..... 2015-247819

(51) Int. Cl.
*G03G 15/16* (2006.01)

(52) U.S. Cl.
CPC ..... *G03G 15/161* (2013.01)

(58) Field of Classification Search
CPC ..... G03G 15/1675; G03G 15/168; G03G 15/1685; G03G 2215/1652; G03G 2215/1647
USPC ..... 399/101
See application file for complete search history.

(56) References Cited

U.S. PATENT DOCUMENTS 5,233,394 A * 8/1993 Fujita ..... G03G 15/168 399/101
8,131,196 B2 * 3/2012 Suzuki ..... G03G 15/1685 399/101
2006/0245782 A1 * 11/2006 Hirai ..... G03G 15/168 399/101
2009/0060595 A1 * 3/2009 Horiuchi ..... G03G 15/161 399/285
2010/0329707 A1 * 12/2010 Yamada ..... G03G 15/161 399/44
2012/0027442 A1 2/2012 Torimaru
2012/0237234 A1 * 9/2012 Sugimoto ..... G03G 15/1675 399/50
2012/0315055 A1 * 12/2012 Zaima ..... G03G 15/5041 399/49
2013/0011155 A1 * 1/2013 Ogiyama ..... G03G 15/0189 399/66
2013/0016983 A1 1/2013 Kawakami
2015/0284197 A1 * 10/2015 Shigihara ..... B65H 5/025 271/277

(Continued)

FOREIGN PATENT DOCUMENTS

JP S63-56674 A 3/1988
JP H06-186866 A 7/1994
JP 2002-116642 A 4/2002

(Continued)

OTHER PUBLICATIONS

Jul. 26, 2016 Office Action issued in Japanese Patent Application No. 2015-247819.

*Primary Examiner* — Francis Gray
(74) *Attorney, Agent, or Firm* — Oliff PLC

(57) ABSTRACT

A transfer device includes a transfer unit including an image carrier that carries a toner image to be transferred to a transfer surface of a recording medium, a transfer member disposed on a non-transfer-surface side of the recording medium, and an opposing member disposed opposite the transfer member with the image carrier therebetween; a cleaning unit that cleans a surface of the transfer member; a first application unit that applies a voltage, for transferring the toner image, to the opposing member; and a second application unit that applies an alternating voltage to the transfer member.

13 Claims, 15 Drawing Sheets

| | CLEANING ROLLER (BELT) POTENTIAL Vcln | : | SECOND-TRANSFER ROLLER POTENTIAL Vbtr | : | BACKUP ROLLER POTENTIAL Vbur |
|---|---|---|---|---|---|
| PATTERN 2–1 | 3 kV | > | 2 kVave | > | 0 kV |
| PATTERN 2–2 | 1 kV | > | 0 kVave | > | −2 kV |
| PATTERN 2–3 | −1 kV | > | −2 kVave | > | −4 kV |

(56) References Cited

U.S. PATENT DOCUMENTS

2015/0338792 A1* 11/2015 Nakamura ..... G03G 15/1665
399/66

FOREIGN PATENT DOCUMENTS

| | | | | |
|---|---|---|---|---|
| JP | 2006267219 | A | * | 10/2006 |
| JP | 2012-032484 | A | | 2/2012 |
| JP | 2012-037762 | A | | 2/2012 |
| JP | 2012-237974 | A | | 12/2012 |
| JP | 2013-020040 | A | | 1/2013 |
| JP | 2013020040 | A | * | 1/2013 |
| JP | 2013-092638 | A | | 5/2013 |
| JP | 2013092743 | A | * | 5/2013 |
| JP | 2014-145988 | A | | 8/2014 |
| JP | 2015-187723 | A | | 10/2015 |
| JP | 2015187723 | A | * | 10/2015 |

* cited by examiner

FIG. 4

| | SECOND-TRANSFER ROLLER POTENTIAL Vbtr | : | BACKUP ROLLER POTENTIAL Vbur |
|---|---|---|---|
| PATTERN 1–1 | 2 kVave | > | 0 kV |
| PATTERN 1–2 | 0 kVave | > | −2 kV |
| PATTERN 1–3 | −2 kVave | > | −4 kV |

<EVALUATION CONDITIONS>
TONER CHARACTERISTIC: NEGATIVELY CHARGED TONER
SHEET: A4 Ncolor209
APPLIED AMOUNT OF TONER: 240% (7.5 g/m$^2$)
IMAGE SIZE: 214×301 mm (A4+2 mm)

EVALUATIONS OF BACK-SURFACE SMEARS FOR DIFFERENT NUMBERS OF PRINTS
(○: GOOD, △: FAIR, ×: BAD, ***: NO EVALUATION)

| BTR | 1 PV | 15 kPV | 50 kPV | 100 kPV |
|---|---|---|---|---|
| 0 V (GROUNDED) | ○ | × | *** | *** |
| 0 V + AUXILIARY BLADE A | ○ | ○ | × | *** |
| 0 V + AUXILIARY BLADE B | ○ | ○ | × | *** |
| AC APPLIED | ○ | ○ | ○ | △ |
| AC + AUXILIARY BLADE A | ○ | ○ | ○ | ○ |
| AC + AUXILIARY BLADE B | ○ | ○ | ○ | ○ |
| AC + AUXILIARY BLADES A, B | ○ | ○ | ○ | ○ |

FIG. 8

| | CLEANING ROLLER (BELT) POTENTIAL Vcln | : | SECOND-TRANSFER ROLLER POTENTIAL Vbtr | : | BACKUP ROLLER POTENTIAL Vbur |
|---|---|---|---|---|---|
| PATTERN 2–1 | 3 kV | > | 2 kVave | > | 0 kV |
| PATTERN 2–2 | 1 kV | > | 0 kVave | > | −2 kV |
| PATTERN 2–3 | −1 kV | > | −2 kVave | > | −4 kV |

<EVALUATION CONDITIONS>
TONER CHARACTERISTIC: NEGATIVELY CHARGED TONER
SHEET: A4 Ncolor209
APPLIED AMOUNT OF TONER: 240% (7.5 g/m$^2$)
IMAGE SIZE: 214×301 mm (A4+2 mm)

EVALUATIONS OF BACK-SURFACE SMEARS FOR DIFFERENT NUMBERS OF PRINTS
(○: GOOD, △: FAIR, ×: BAD, ***: NO EVALUATION)

| BTR | 1 PV | 15 kPV | 50 kPV | 100 kPV |
|---|---|---|---|---|
| 0 V (GROUNDED) | × | *** | *** | *** |
| 0 V+AUXILIARY BLADE A | × | *** | *** | *** |
| 0 V+AUXILIARY BLADE B | × | *** | *** | *** |
| AC+CLNDC 0 V | × | *** | *** | *** |
| AC+CLNDC −1.0 kV | × | *** | *** | *** |
| AC+CLNDC +1.0 kV | ○ | ○ | ○ | △ |
| AC+AUXILIARY BLADE A | ○ | ○ | ○ | ○ |
| AC+AUXILIARY BLADE B | ○ | ○ | ○ | ○ |
| AC+AUXILIARY BLADES A, B | ○ | ○ | ○ | ○ |

TRANSFER DEVICE AND IMAGE FORMING APPARATUS

CROSS-REFERENCE TO RELATED APPLICATIONS

This application is based on and claims priority under 35 USC 119 from Japanese Patent Application No. 2015-247819 filed Dec. 18, 2015.

BACKGROUND

Technical Field

The present invention relates to a transfer device and an image forming apparatus.

During a transfer operation, toner particles (hereinafter, simply referred to as "toner") applied to a part of a transfer member beyond the edges of a sheet may leave smears on the back surface of the sheet. In particular, toner smears tend to be left on the back surface of a sheet when, for example, forming an image on the entire region of the sheet (hereinafter, referred to as "borderless printing").

SUMMARY

According to an aspect of the present invention, a transfer device includes a transfer unit including an image carrier that carries a toner image to be transferred to a transfer surface of a recording medium, a transfer member disposed on a non-transfer-surface side of the recording medium, and an opposing member disposed opposite the transfer member with the image carrier therebetween; a cleaning unit that cleans a surface of the transfer member; a first application unit that applies a voltage, for transferring the toner image, to the opposing member; and a second application unit that applies an alternating voltage to the transfer member.

BRIEF DESCRIPTION OF THE DRAWINGS

Exemplary embodiments of the present invention will be described in detail based on the following figures, wherein:

FIG. 4 is a table showing the relationship between the potential of a second-transfer roller and the potential of a backup roller according to the first exemplary embodiment;

FIG. 8 is a table showing the relationship between the potential of a second-transfer roller and the potential of a backup roller according to the second exemplary embodiment;

DETAILED DESCRIPTION

First Exemplary Embodiment

Figure 1:
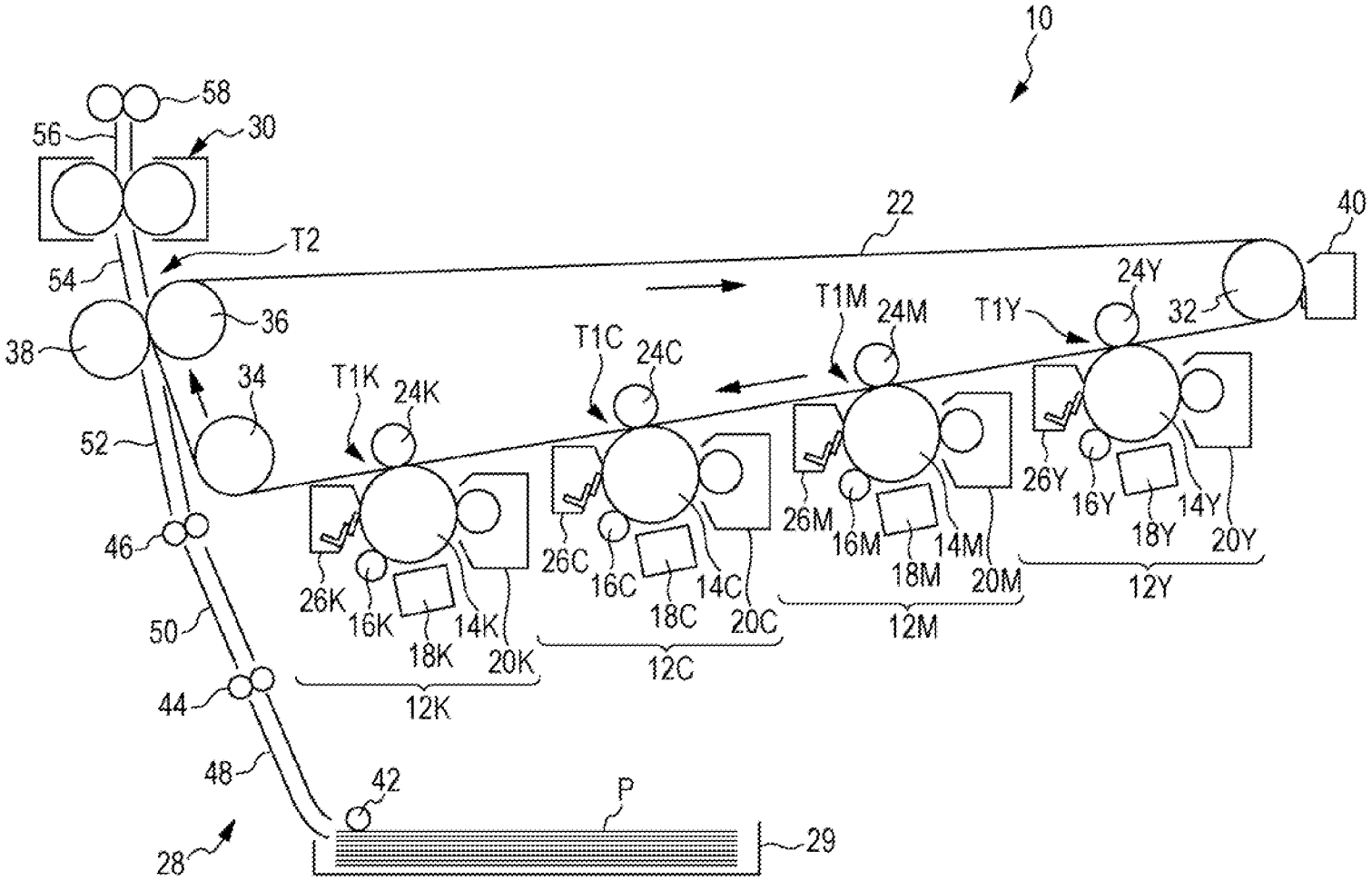
FIG. 1 is a front view of an image forming apparatus according to a first exemplary embodiment.

FIG. 1 is a schematic view of an image forming apparatus 10 according to a first exemplary embodiment.

The image forming apparatus 10 is a four-unit tandem image forming apparatus that is capable of forming a full-color image (also referred to as "printing"). The image forming apparatus 10 includes a first image forming unit 12Y, a second image forming unit 12M, a third image forming unit 12C, and a fourth image forming unit 12K, which respectively form a yellow (Y) image, a magenta (M) image, a cyan (C) image, and a black (K) image by using an electrophotographic method. The image forming units 12Y, 12M, 12C, and 12K are arranged in this order from the upstream side so as to be spaced apart from each other by a predetermined distance. In the following description, "image forming" and "printing" will be used synonymously. The term "printing" will be used, for example, in "borderless printing", because it is more generally used than "borderless image forming".

In the following description, each of the first image forming unit 12Y, the second image forming unit 12M, the third image forming unit 12C, and the fourth image forming unit 12K will be referred to as the "image forming unit 12", because the four image forming units have the same structure. When it is not necessary to distinguish between corresponding components of the image forming units 12, the characters "Y", "M", "C", and "K" at the ends of the numerals of the components, which are shown in the figures, may be omitted in the description.

The image forming unit 12 includes a photoconductor drum 14, a charger 16, an exposure device 18, a developing device 20, and a cleaning device 26. The photoconductor drum 14 has photoconductor layer on a surface thereof. The charger 16 uniformly charges the photoconductor drum 14. The exposure device 18 irradiates the uniformly charged photoconductor drum 14 with light to form an electrostatic latent image. The developing device 20 forms a toner image by transferring toner to the latent image. The cleaning device 26 removes toner remaining on the photoconductor drum 14 after transfer.

The image forming apparatus 10 further includes an intermediate transfer belt (IBT) 22 and first-transfer rollers 24. The intermediate transfer belt (IBT) 22, which is an example of an image carrier, is rotatably looped along a path that is in contact with the photoconductor drums 14 of the four image forming units 12. Each of the first-transfer rollers 24 transfers a toner image formed on a corresponding one of the photoconductor drums 14 to the intermediate transfer belt 22. The photoconductor drums 14 and the first-transfer rollers 24 face each other in first-transfer sections T1.

The image forming apparatus 10 further includes a recording sheet transport mechanism 28 and a fixing device 30. The recording sheet transport mechanism 28 transports a recording sheet P from a sheet tray 29. The fixing device 30 fixes a toner image onto the recording sheet P.

The intermediate transfer belt 22 is looped over a drive roller 32 that rotates the intermediate transfer belt 22; a tension roller 34 that adjusts the tension of the intermediate transfer belt 22; and a backup roller (BUR) 36, which is an example of an opposing member. The first-transfer rollers 24 are disposed inside the loop of the intermediate transfer belt 22.

A second-transfer roller (2ndBTR) 38, which is an example of a transfer member, is disposed opposite the backup roller (BUR) 36 with the intermediate transfer belt 22 therebetween. The second-transfer roller 38 transfers a toner image on the intermediate transfer belt 22 to a recording sheet P that is being transported by the recording sheet transport mechanism 28. The backup roller 36 and the second-transfer roller 38 face each other in a second-transfer section T2.

A toner removing device 40 is disposed opposite the drive roller 32 with the intermediate transfer belt 22 therebetween. The toner removing device 40 removes toner from the intermediate transfer belt 22 after the second-transfer roller 38 has transferred toner images from the inter mediate transfer belt 22 to the recording sheet P.

The recording sheet transport mechanism 28 includes a pick-up roller 42; transport rollers 44 and 46; paper guides 48, 50, 52, 54, and 56 that form a recording-sheet transport path; sheet-output rollers 58; and a sheet output tray (not shown). The recording sheet transport mechanism 28 transports a recording sheet P from the sheet tray 29 to a second-transfer position, where the second-transfer roller 38 and the backup roller 36 are disposed opposite other with the intermediate transfer belt 22 therebetween. Then, the recording sheet transport mechanism 28 transports the recording sheet P from the second-transfer position to the fixing device 30, and from the fixing device 30 to the sheet output tray.

Engine Control System

Figure 2:
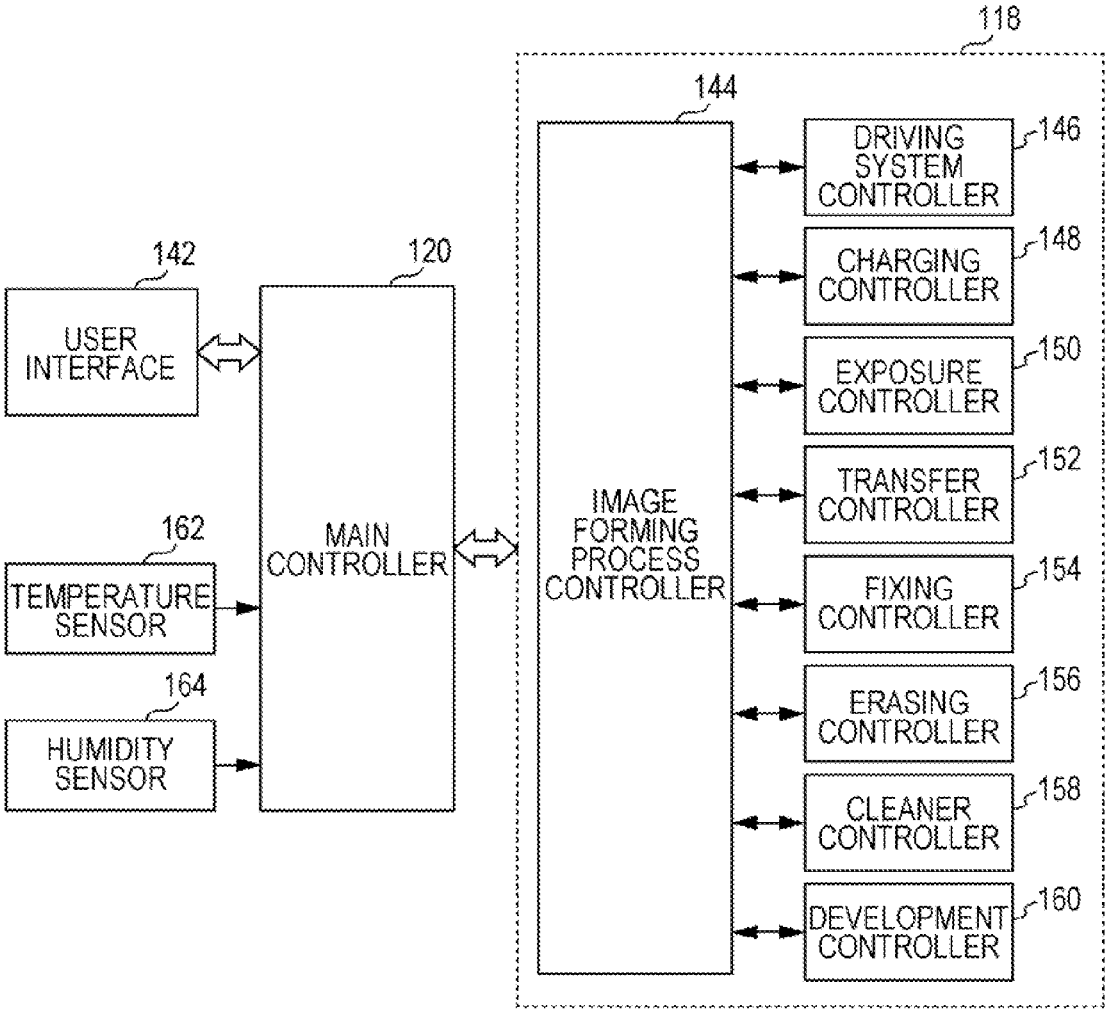
FIG. 2 is a control block diagram of an image forming process engine of the image forming apparatus according to the first exemplary embodiment.

FIG. 2 is a control block diagram illustrating an example of the control system of the image forming apparatus 10.

A user interface 142 is connected to a main controller 120 of the image forming apparatus 10. The user interface 142 includes an input unit, to which a user inputs a command related to an image forming operation or the like, and an output unit, which notifies information about an image forming operation or the like by using display or sound.

Image data is input to the main controller 120 through a network line, which is connected to an external host computer (not shown).

When image data is input, the main controller 120 analyses, for example, the image data and print command information included in the image data, converts the data format of the image data into a data format (for example, bitmap) that is compatible with the image forming apparatus 10, and feeds the converted image data to an image forming process controller 144, which functions as a part of an MCU 118.

On the basis of input image data, the image forming process controller 144 performs an image forming operation by synchronously controlling a driving system controller 146, a charging controller 148, an exposure controller 150, a transfer controller 152, a fixing controller 154, an erasing controller 156, a cleaner controller 158, and a development controller 160. Each of these controllers functions as a part of the MCU 118, as with the image forming process controller 144. In the first exemplary embodiment, the functions performed by the MCU 118 are divided into blocks. However, these blocks do not limit the hardware structure of the MCU18.

A temperature sensor 162, a humidity sensor 164, and the like may be connected to the main controller 120. In this case, the temperature sensor 162 and the humidity sensor 164 detect the ambient temperature and the humidity of the inside of the housing of the image forming apparatus 10.

Borderless Printing

Typically, in an image forming process, an image forming region of a recording medium P is set so as to leave predetermined margins from the edges the recording sheet P.

However, the entire area of a recording sheet, without any margins, may be set as an image forming region. An operation of forming an image on a recording sheet P without leaving any margins may be referred to as "borderless printing".

In borderless printing, a toner image larger than the entire region of a recording sheet P (for example, 2 mm larger than each of the long side and a short side of an A4 -sized recording sheet P) is formed on the intermediate transfer belt 22 in the first-transfer section T1, and the toner image is transferred to the recording sheet P in the second-transfer section T2.

Therefore, if toner is applied to an area of the intermediate transfer belt 22 beyond the edges of a recording sheet P and transferred to the second-transfer roller 38, as the second-transfer roller 38 rotates, the toner may leave smears on the back surface of the recording sheet P repeatedly in accordance with the rotation cycle of the second-transfer roller 38.

Moreover, because the second-transfer roller 38 directly contacts the recording sheet P, calcium carbonate particles (hereinafter, simply referred to as "calcium carbonate") included in paper dust of the recording sheet P may be transferred from the recording sheet P to the second-transfer roller 38 and may cause so-called "filming", which is a phenomenon in which the calcium carbonate deposits on the surface of the second-transfer roller 38 to form a thin layer adhering the surface.

In the first exemplary embodiment, in order to efficiently remove toner and calcium carbonate adhering to the second-transfer roller 38, the surface roughness of the surface of the second-transfer roller 38 is adjusted by covering the surface with a resin film 60 (see FIGS. 3A to 3D) and by disposing a cleaning blade 62 (see FIGS. 3A to 3D) so as to be in contact with the surface of the second-transfer roller 38 (the resin film 60). The cleaning blade 62 functions as a cleaning member that mechanically removes toner (as described below in detail).

The resin film 60 prevents entry of toner and calcium carbonate into an elastic member 64 (see FIGS. 3A to 3D), which is a porous member of the second-transfer roller 38. Moreover, the cleaning blade 62 scrapes toner and calcium carbonate from the surface of the second-transfer roller 38 as the second-transfer roller 38 rotates.

Hereinafter, the structure of the second-transfer section T2, that is, the second-transfer roller 38 and the surrounding region will be described in detail.

Figure 3A:
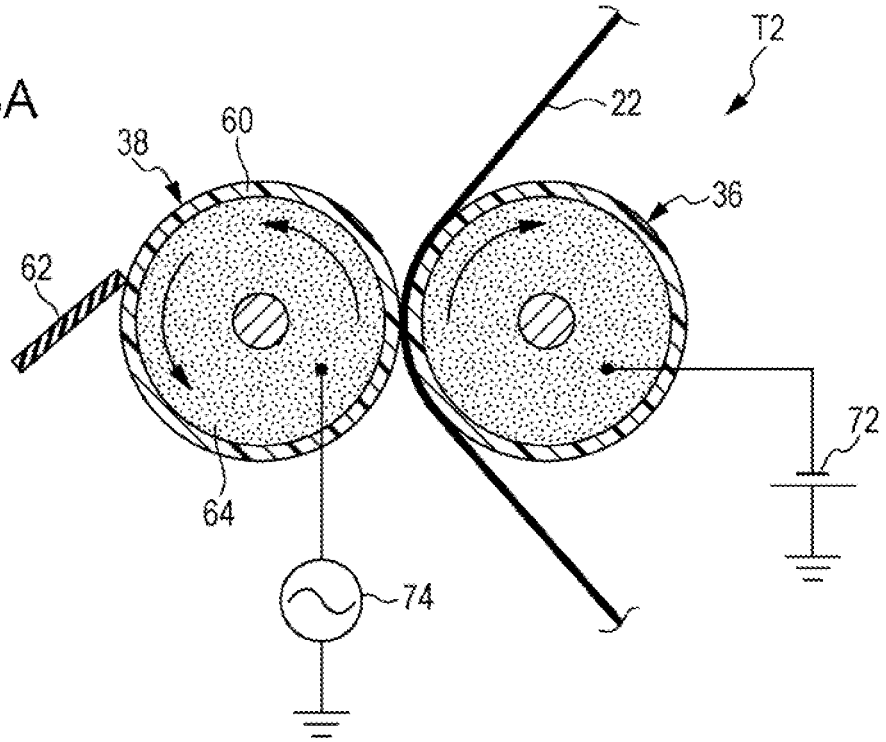
FIGS. 3A to 3D are enlarged views illustrating the structures of a second-transfer section according to the first exemplary embodiment, FIG. 3A illustrating a basic structure, FIG. 3B illustrating a first additional structure, FIG. 3C illustrating a second additional structure, and FIG. 3D illustrating a third additional structure.
Figure 3B:
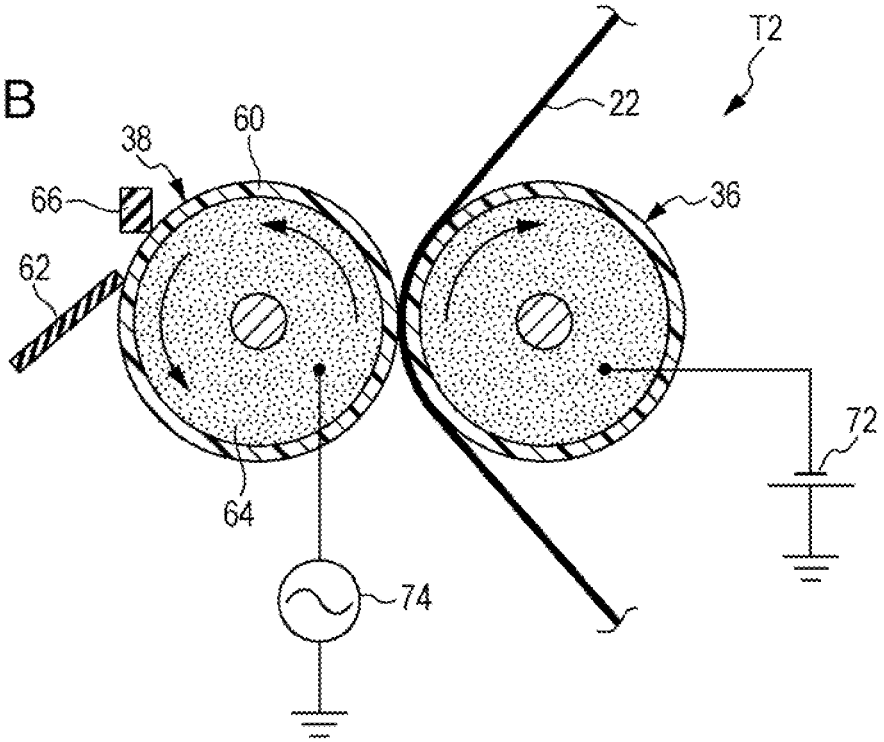
Figure 3C:
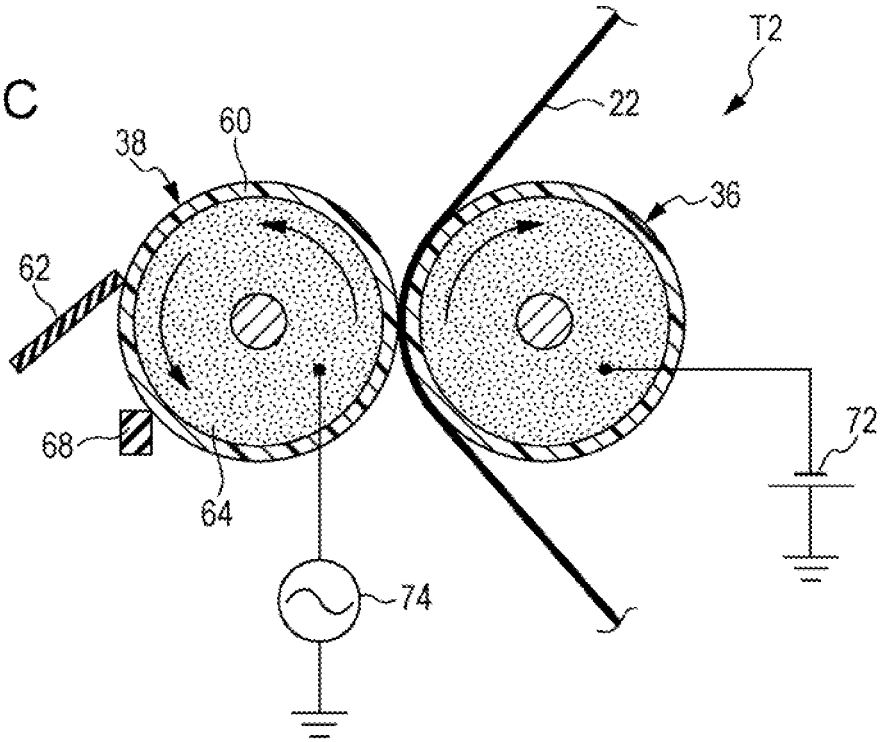
Figure 3D:
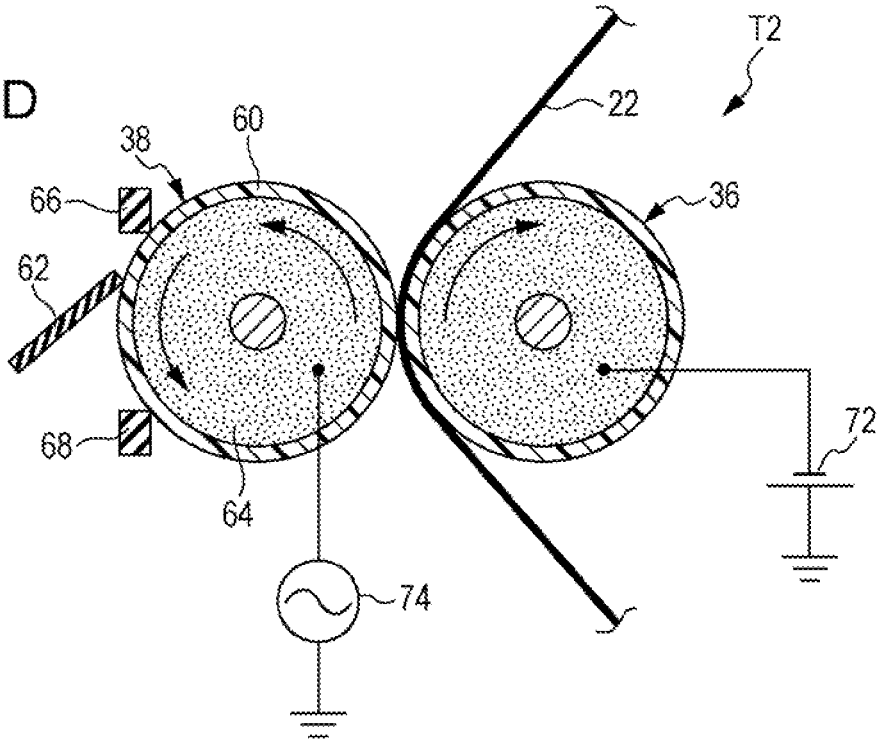

FIG. 3A is an enlarged view of the second-transfer section T2, where the second-transfer roller 38 is in contact with the intermediate transfer belt 22, which is looped over the backup roller 36. FIG. 3A illustrates a representative cleaning-blade disposition structure (basic structure). FIGS. 3B to 3D respectively illustrate first to third additional structures respectively including, in addition to the cleaning blade 62, an auxiliary blade 66, an auxiliary blade 68, and both of these.

Basic Structure

The second-transfer section T2 illustrated in FIG. 3A has the basic structure.

As described above, the second-transfer roller 38 is disposed opposite the intermediate transfer belt 22, which is looped over the backup roller 36. Second-transfer is performed when the recording sheet P passes through the nip between the intermediate transfer belt 22 and the second-transfer roller 38.

The second-transfer roller 38 includes a core 70 and the elastic member 64, which is cylindrical and attached to the core 70. The elastic member 64 may be made of foamed polyurethane rubber, which is porous. Therefore, the surface of the elastic member 64 is rough and has a surface roughness Rz of 0.2 μm or greater. The peripheral surface of the elastic member 64 is covered with the resin film 60. The resin film 60 may be made from a polyimide resin (PI) tube or a polyamide-imide resin (PAI) tube.

In a transfer step, the resin film 60 serves to prevent entry of toner and calcium carbonate into the inside of the elastic member 64 and to hold toner and calcium carbonate on the surface of the second-transfer roller 38. Thus, it is easy to remove toner and calcium carbonate held on the surface of the second-transfer roller 38.

Mechanical Removal

The cleaning blade 62, for removing toner adhering to the second-transfer roller 38, is disposed so as to be in contact with the peripheral surface of the second-transfer roller 38. The cleaning blade 62 is an example of a cleaning member.

The cleaning blade 62 is a plate-shaped blade that is made of an elastic material and has a predetermined thickness. The cleaning blade 62 is made of a material having appropriate mechanical properties, such as high wear resistance, high chipping resistance, and high creeping resistance. Examples of such a material include thermosetting polyurethane rubber.

The material of the cleaning blade 62 is not limited to polyurethane rubber and may be another functional rubber material, such as silicone rubber, fluorocarbon resin rubber, or ethylene propylene diene rubber.

The blade pressing method used in the first exemplary embodiment is a constant-displacement method, which may be implemented in a simple and low-cost structure. However, the blade pressing method is not limited to a constant-displacement method and may be a constant-load method, which generates a contact pressure that is substantially constant with time.

In the step of second-transferring an image to a recording sheet P, the cleaning blade 62 scrapes off toner adhering to a part of the surface of the second-transfer roller 38 beyond the edges of the recording sheet P, and thereby reduces toner smears on the back surface of the recording sheet P.

Paper dust (mainly composed of calcium carbonate), which is generated due to friction between the second-transfer roller 38 and a recording sheet P, may adhere to the second-transfer roller 38. The cleaning blade 62 scrapes off the calcium carbonate to maintain the roughness of the surface of the second-transfer roller 38 within a reference range (for example, Rz<0.2 μm) to maintain its toner scraping function.

Electrical Removal (Assistance in Mechanical Removal)

In the second-transfer section T2, a direct-current power source 72 applies a direct-current voltage Vbur (having the same polarity as the toner potential) to the backup roller 36. The direct-current voltage Vbur is used to transfer a toner image on the intermediate transfer belt 22, which is composed of negatively charged toner, to a recording sheet P (shown in FIG. 1, but not shown in FIGS. 3A to 3D). The toner image is transferred to the recording medium P when the recording sheet P passes through the nip between the intermediate transfer belt 22 and the second-transfer roller 38. The direct-current power source 72 functions as a first application unit.

In borderless printing, toner is directly transferred to a part of the second-transfer roller 38 beyond the edges (in particular, the leading edge and the trailing edge) of a recording sheet P.

In the first exemplary embodiment, an alternating-voltage power source 74 applies an alternating voltage Vbtr to the second-transfer roller 38. The alternating voltage Vbtr is set by setting the values of predetermined parameters, which are frequency f, duty ratio, amplitude potential Vpp, and the average value Vave. The alternating-voltage power source 74 functions as a second application unit.

Figure 5A:
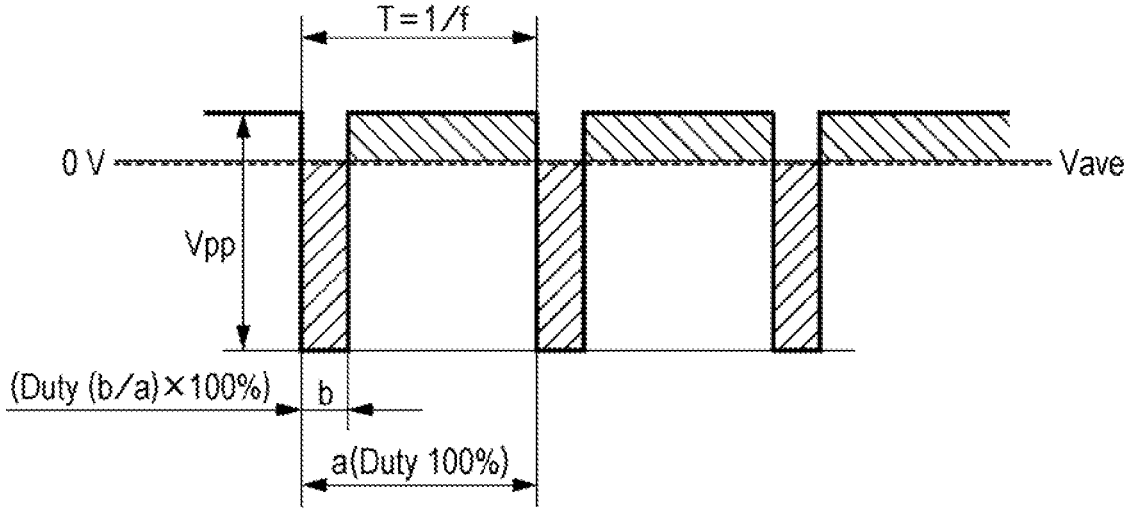
FIGS. 5A and 5B are characteristic graphs of an alternating voltage applied to the second-transfer roller according to the first exemplary embodiment, FIG. 5A illustrating an example in which the average voltage Vave is 0 V, and FIG. 5B illustrating an example in which the average voltage Vave is higher than 0 V.
Figure 5B:
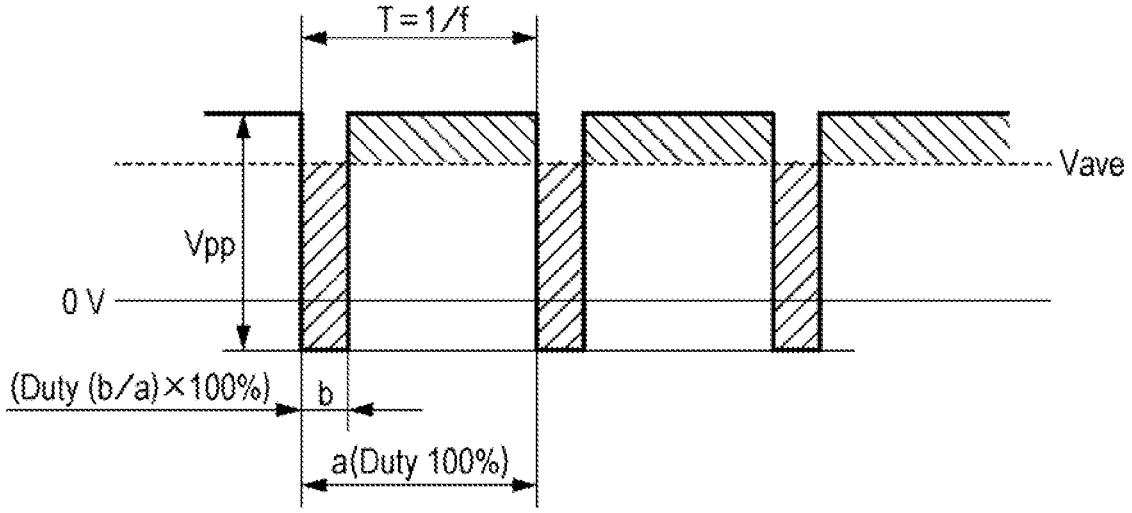

FIGS. 5A and 5B schematically illustrate the definitions of the frequency f, the duty ratio, the Vpp, and the Vave of the alternating voltage Vbtr.

The frequency f is the reciprocal of the period T shown in FIGS. 5A and 5B (f=1/T).

The duty ratio is the ratio of the width b of a minimum-potential interval to the width a of one period.

The amplitude potential Vpp is the absolute value of the difference between the maximum potential and the minimum potential.

The average value Vave is a voltage with respect to 0 V. For example, FIG. 5A illustrates an example in which the average value Vave is 0 V, and FIG. 5B illustrates an example in which the average value Vave is higher than 0 V.

When the alternating voltage Vbtr, which is determined by the aforementioned parameters, is applied to the second-transfer roller 38, in relation to the polarity of the direct-current voltage Vbur applied to the backup roller 36, toner that is being transferred from the intermediate transfer belt 22 vibrates (reciprocates) in the nip between the intermediate transfer belt 22 and the second-transfer roller 38.

In the first exemplary embodiment, the gap having the nip width, in which toner vibrates (reciprocates), is less than the thickness of a recording sheet P. Therefore, the meaning of the term "vibrate (reciprocate)" includes a meaning that toner physically moves between the intermediate transfer belt 22 and the second-transfer roller 38 and a meaning that toner does not move between the intermediate transfer belt 22 and the second-transfer roller 38 but an object to which the toner is to be transferred is switched as the polarity is switched.

The number of vibrations (the number of reciprocations) is adjustable by changing the alternating voltage Vbtr (predetermined frequency, duty ratio, Vpp, and Vave). In the first exemplary embodiment, the alternating voltage Vbtr is set so that the number of vibrations (the number of reciprocations) of toner is once or more and eight times or less (in the range of 1 to 8 times) when the toner moves in the nip width d between the intermediate transfer belt 22 and the second-transfer roller 38.

The number of vibrations n may be represented as the frequency of the alternating voltage Vbtr. The frequency f, which is the reciprocal of the period T (f=1/T) is represented as follows:

$$f=(n/d)\times v \tag{1}$$

where d is the nip width, and v is the peripheral velocity of the second-transfer roller 38 moving the nip width d.

Accordingly, the number of vibrations in the range of one to eight is represented by the frequency f (Hz) as follows:

$$\{(n1/d)\times v\}\leq f\leq\{(n8/d)\times v\} \tag{2}$$

where n1 denotes one vibration and n8 denotes eight vibrations.

Note that the expression (1) is obtained by converting a period T to a frequency f as follows:

$$f=1/T=1/\{(d/n)/v\}=\{v/(d/n)\}=\{(n\times v)/d\}=(n/d)\times v.$$

That is, the frequency f for causing toner to vibrate once within the nip width d is lower than the frequency f for causing toner to vibrate eight times within the nip width d.

Exemplary Calculation

A simple example is as follows: when the nip width d between the intermediate transfer belt 22 and the second-transfer roller 38 is 1 mm and the peripheral velocity v of the second-transfer roller 38 is 100 mm/sec, toner adhering to the intermediate transfer belt 22 moves the nip width d in 0.01 seconds (d/v=1/100).

That is, the period T of one vibration is (d/n1)/v, which is 0.01 seconds/cycle. Accordingly, the frequency f is the reciprocal (1/T), which is 100 Hz.

The period T of eight vibrations is (d/n8)/v, which is 0.00125 seconds/cycle (0.01 seconds/8 times). Accordingly, the frequency f is the reciprocal, which is 800 Hz.

In the above example, simple values are selected for ease of calculation. Note that these values are not necessarily suitable for an actual operation of the image forming apparatus 10.

FIG. 4 is a table showing examples of setting patterns (patterns 1-1 to 1-3) of the alternating voltage Vbtr (the average voltage Vave) and the direct-current voltage Vbur. In any of these patterns, the average value Vave of the alternating voltage Vbtr is higher than the direct-current voltage Vbur.

The voltages are set so that toner vibrates (reciprocates) once or more in the nip between the intermediate transfer belt 22 and the second-transfer roller 38 for the following reason: when a voltage for causing toner to vibrate once is applied, the force of adhesion of the toner to the second-transfer roller 38 is reduced to a level that allows the cleaning blade 62 to scrape (remove) the toner from the second-transfer roller 38 without fail.

The voltages are set so that toner vibrates (reciprocates) eight times or less in the nip between the intermediate transfer belt 22 and the second-transfer roller 38 for the following reason: if a voltage for causing toner to vibrate more than eight times is applied, the frequency of the alternating voltage Vbtr is excessively high and the vibrations of the toner are weakened, and therefore the force of adhesion of toner to the second-transfer roller 38 becomes a level that does not allow the cleaning blade 62 to scrape off (remove) the toner without fail.

First Additional Structure (Upstream Auxiliary Blade 66)

FIG. 3B illustrates a second-transfer section having a first additional structure in which, in addition to the basic structure, the auxiliary blade 66 is disposed on the upstream side of the cleaning blade 62.

The upstream auxiliary blade 66 functions as a pre-cleaning blade that removes toner from the second-transfer roller 38 before the cleaning blade 62 removes toner from the second-transfer roller 38.

The first additional structure is capable of, in addition to decreasing the force of adhesion of toner due to application of the alternating voltage Vbtr to the second-transfer roller 38, increasing the cleaning ability by removing part of toner beforehand when the amount of the toner is large.

Second Additional Structure (Downstream Auxiliary Blade 68)

FIG. 3C illustrates a second-transfer section having a second additional structure in which, in addition to the basic structure, the auxiliary blade 68 is disposed on the downstream side of the cleaning blade 62.

The downstream auxiliary blade 68 functions as a post-cleaning blade that removes remaining toner, which is not removed from the second-transfer roller 38 by the cleaning blade 62, from the second-transfer roller 38.

The second additional structure is capable of, in addition to decreasing the force of adhesion of toner due to application of the alternating voltage Vbtr to the second-transfer roller 38, increasing the cleaning ability by removing a part of toner that is not removed by the cleaning blade 62.

Third Additional Structure (Upstream Auxiliary Blade 66 and Downstream Auxiliary Blade 68)

FIG. 3D illustrates a second-transfer section having a third additional structure in which, in addition to the basic structure, the auxiliary blade 66 is disposed on the upstream side of the cleaning blade 62 and the auxiliary blade 68 is disposed on the downstream side of the cleaning blade 62.

The upstream auxiliary blade 66 functions as a pre-cleaning blade that removes toner from the second-transfer roller 38 before the cleaning blade 62 removes toner from the second-transfer roller 38.

The downstream auxiliary blade 68 functions as a post-cleaning blade that removes remaining toner, which is not removed by the cleaning blade 62 and remains on the second-transfer roller 38, from the second-transfer roller 38.

In the first exemplary embodiment, by applying the alternating voltage Vbtr to the second-transfer roller 38, toner is vibrated (reciprocated) in the nip between the intermediate transfer belt 22 and the second-transfer roller 38. The second-transfer section may have any one of the basic structure and the first to third additional structures.

Hereinafter, an operation of the first exemplary embodiment will be described.

Ordinary Image Forming Process Mode

Because the image forming units 12 have substantially the same structure, the first image forming unit 12Y, which is disposed in an upstream region in the rotation direction of the intermediate transfer belt 22 and which forms an yellow image, will be described as a representative example. By respectively denoting components of the second to fourth image forming units 12M, 12C, and 12K by numerals to which magenta (M), cyan (C), and black (K) are attached instead of yellow (Y), description of the second to fourth image forming units 12M, 12C, and 12K will be omitted.

First, before starting the operation, the charger 16Y charges the surface of the photoconductor drum 14Y to a potential of −800 V in the first exemplary embodiment. Generally, the charging potential is selectable in the range of −600 V to −800 V.

The photoconductor drum 14Y includes an electroconductive metal body and a photoconductive layer formed on the metal body. The photoconductor drum 14Y normally has a high resistance. However, when a part of the photoconductor drum 14Y is irradiated with LED light, the resistance of the portion changes.

When image data for yellow is sent from the main controller 120 to the MCU 118, the exposure device 18 emits an exposure light beam (such as an LED light beam) toward the surface of the photoconductor drum 14Y in accordance with the image data. The surface of the photoconductive layer of the photoconductor drum 14Y is irradiated with the light beam, and thereby an electrostatic latent image of a yellow printing pattern is formed on the surface of the photoconductor drum 14Y.

The electrostatic latent image is a so-called negative latent image formed on the surface of the photoconductor drum 14Y due to charging. The electrostatic latent image is formed because the resistivity of a part of the photoconductive layer irradiated with the light beam is reduced and charges on the surface of the photoconductor drum 14Y flow away while charges on a part of the photoconductor layer that is not irradiated with the light beam remain.

The electrostatic latent image, which is formed on the photoconductor drum 14Y as described above, is rotated to a development position as the photoconductor drum 14Y rotates. At the development position, the developing device 20Y develops the electrostatic latent image on the photoconductor drum 14Y into a visible image (toner image).

The developing device 20Y contains yellow toner, which is manufactured by using an emulsion polymerization method. The yellow toner, which is agitated in the developing device 20Y, is charged by friction to have the same (negative) polarity as the surface of the photoconductor drum 14Y.

As the surface of the photoconductor drum 14Y passes through the developing device 20Y, the yellow toner electrostatically adheres to only a part of a latent image on the photoconductor drum 14Y from which charges have been erased, and the latent image is developed by using the yellow toner.

As the photoconductor drum 14Y continues rotating, the toner image developed on the surface of the photoconductor drum 14Y is transported to a first-transfer position. When the yellow toner image on the surface of the photoconductor drum 14Y is transported to the first-transfer position, a first-transfer bias is applied to the first-transfer roller 24Y. Accordingly, the toner image receives an electrostatic force in the direction from the photoconductor drum 14Y toward the first-transfer roller 24Y to the toner image, and the toner image is transferred from the surface of the photoconductor drum 14Y to the surface of the intermediate transfer belt 22.

The transfer bias has the positive polarity, which is opposite to the negative polarity of the toner. For example, in the first image forming unit 12Y, the transfer controller 152 performs constant-current control to keep the transfer bias in the range of about +20 to 30 μA.

The cleaning device 26Y removes residual toner remaining on the surface of the photoconductor drum 14Y after transfer.

First-transfer biases applied to the first-transfer rollers 24M, 24C, and 24K of the second to fourth image forming units 12M, 12C, and 12K are controlled in the same way as described above.

The intermediate transfer belt 22, to which the first image forming unit 12Y has transferred a yellow toner image, passes through the second to fourth image forming units 12M, 12C, and 12K successively, and magenta, cyan, and black toner images are transferred in an overlapping manner.

After all the image forming units 12 have transferred all the color toner images to the intermediate transfer belt 22 in an overlapping manner, the intermediate transfer belt 22 is rotated in the direction of an arrow. Then, the color toner images reach the second-transfer section T2, including the backup roller 36, which is in contact with the inner surface of the intermediate transfer belt 22, and the second-transfer roller 38, which is disposed on the image-carrying-surface side of the intermediate transfer belt 22.

A feed mechanism feeds a recording sheet P to the nip between the second-transfer roller 38 and the intermediate transfer belt 22 at a predetermined timing, and a second-transfer bias is applied to the second-transfer roller 38.

The second-transfer bias has the positive polarity, which is opposite to the negative polarity of the toner. The toner images receive an electrostatic force from the intermediate transfer belt 22 toward the recording sheet P, and the toner images are transferred from the surface of the intermediate transfer belt 22 to the surface of the recording sheet P.

Subsequently, the recording sheet P is fed into the fixing device 30, which heats and presses the overlapping color toner images to fuse and permanently fix the toner images to the surface of the recording sheet P. After the color image has been fixed to the recording sheet P, the recording sheet P is transported to the output unit, and the color image forming process is finished.

Borderless Printing

In borderless printing, toner applied to an area beyond the edges of the recording sheet P may be transferred to the second-transfer roller 38 and may leave smears on the back surface of the recording sheet P. Moreover, calcium carbonate may be transferred from the recording sheet P to the second-transfer roller 38 and may cause so-called "filming".

To prevent these troubles, the elastic member 64, forming the peripheral surface of the second-transfer roller 38, is covered with the resin film 60, which is a PI tube, a PA tube, or the like. Moreover, the cleaning blade 62, which is disposed so as to be in contact with the second-transfer roller 38, scrapes (removes) toner and calcium carbonate from the second-transfer roller 38 as the second-transfer roller 38 rotates.

However, with mechanical removal performed by using the cleaning blade 62, toner and calcium carbonate firmly adhering to the peripheral surface of the second-transfer roller 38 are not removed sufficiently and part of such toner and calcium carbonate remains on the peripheral surface. In particular, the remaining toner may be transferred from the second-transfer roller 38 to the back surface of the recording sheet P again to leave toner smears on the recording sheet P and may considerably reduce the quality of the recording sheet P.

Therefore, in the first exemplary embodiment, in order to reduce the force of adhesion of toner to the second-transfer roller 38, the alternating voltage Vbtr is applied to the second-transfer roller 38. The alternating voltage Vbtr is set by setting the values of predetermined parameters, which are frequency f (1/period T), duty ratio, amplitude potential Vpp, and average value Vave.

When the alternating voltage Vbtr, which is determined by the aforementioned parameters, is applied to the second-transfer roller 38, in relation to the polarity of the direct-current voltage Vbur applied to the backup roller 36, the polarities of the intermediate transfer belt 22 and the backup roller 36 alternate, and toner that is being transferred from the intermediate transfer belt 22 vibrates (reciprocates) in the nip width between the intermediate transfer belt 22 and the second-transfer roller 38.

In the first exemplary embodiment, the voltages are set so that the number of vibrations (the number of reciprocations) is once or more and eight times or less (in the range of 1 to 8 times).

Figure 6A:
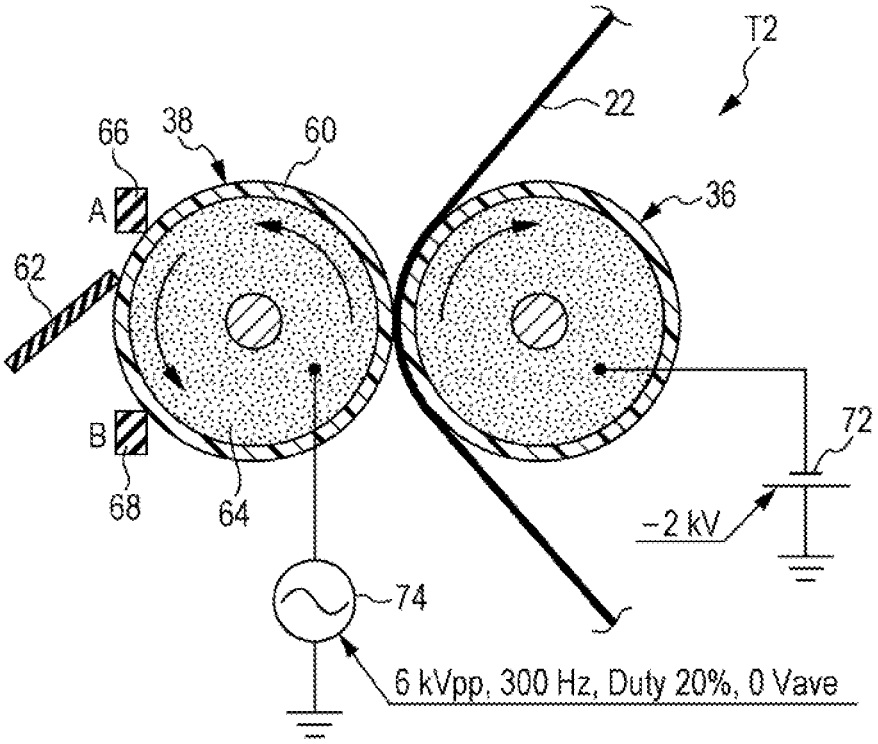
FIGS. 6A to 6C illustrate an exemplary experiment performed to examine the occurrence of toner smears in the second-transfer section according to the first exemplary embodiment, FIG. 6A showing an enlarged view of the second-transfer section having an experimental structure and showing evaluation conditions, FIG. 6B showing evaluations of smears in the second-transfer section for different numbers of vibrations, and FIG. 6C showing evaluations of smears for different numbers of prints performed by using various structures that the first exemplary embodiment, including comparative examples, may have.
Figures 6B, 6C:
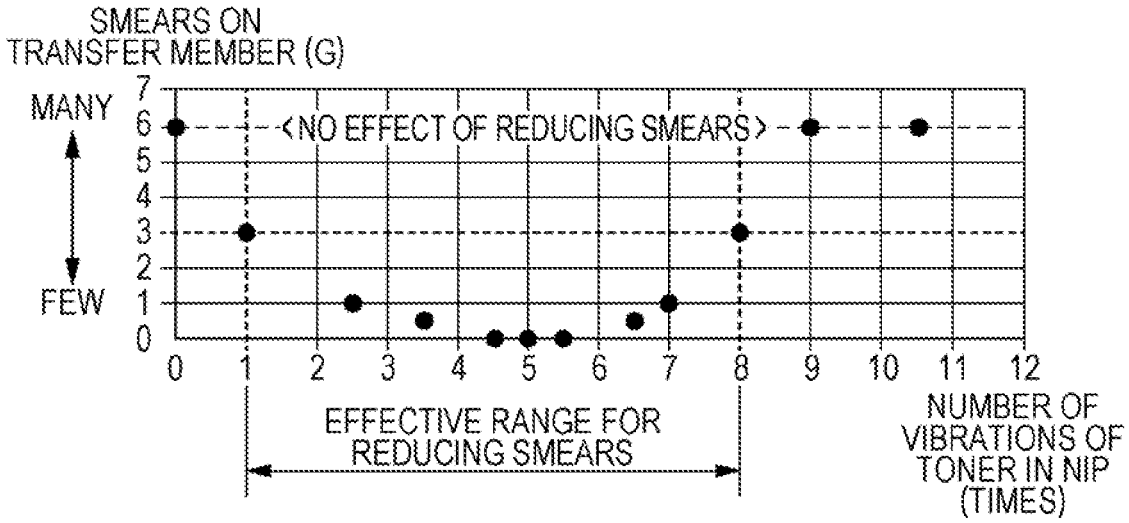

FIGS. 6A to 6C show an example in which toner smear on the back surface of a recording medium P corresponding to the number of prints is evaluated in a case where the alternating voltage Vbtr is applied to the second-transfer section (the first exemplary embodiment) and in a case where the alternating voltage Vbtr is not applied to the second-transfer section (comparative examples). The second-transfer section has one of the basic structure and first to third additional structures shown in FIGS. 3A to 3D.

FIG. 6A illustrates the structure of the second-transfer section T2, in which the upstream auxiliary blade 66 ("A") and the downstream auxiliary blade 68 ("B") are removable. That is, the second-transfer section T2 shown in FIG. 6A, which is designed for an experiment, is capable of having any of the basic structure and the first-second additional structures.

Evaluation is performed under the following preconditions: the direct-current voltage Vbur is −2 kV; and the alternating voltage Vbtr has a frequency of 300 Hz, a duty ratio of 20%, an amplitude voltage Vpp of 12 kV, and an average voltage Vave of 0 kV.

Evaluation conditions are as follows: a negatively charged toner is used, the recording sheets P are A4-sized Ncolor209 sheets (each having the same thickness as a standard post-card), the applied amount of toner is 7.5 g/m$^2$, and the image size is 214 mm×301 mm (2 mm larger than each of the long side and a short side of the A4-sized recording sheet P).

FIG. 6B is a characteristic graph showing the relationship between smears (G) on the transfer member (the second-transfer roller 38) and the number of vibrations (reciprocations) of toner in the nip between the intermediate transfer belt 22 and the second-transfer roller 38. The lower the G-value, the fewer the smears. When the G-value is 3 or lower, it is evaluated that a smear reducing effect is produced.

As shown in FIG. 6B, when the number of vibrations is zero, that is, when toner is removed by using only the cleaning blade 62, the G-value is 6, indicating that a smear reducing effect is not produced. When the number of vibrations is nine times or more, the G-value is 6, indicating that a smear reducing effect is not produced.

Thus, the following results are verified.

Verified Result 1

When toner vibrates (reciprocates) in the nip between the intermediate transfer belt 22 and the second-transfer roller 38 once or more, the force of adhesion of the toner to the second-transfer roller 38 is reduced to a level that allows the cleaning blade 62 to remove (scape) the toner from the second-transfer roller 38 without fail.

Verified Result 2

When the number of times toner vibrates (reciprocates) in the nip between the intermediate transfer belt 22 and the second-transfer roller 38 is eight or more, the frequency of the alternating voltage Vbtr is excessively high and the vibrations of the toner are weakened, so that the force of adhesion of toner to the second-transfer roller 38 becomes a level that does not allow the cleaning blade 62 to scrape (remove) the toner from the second-transfer roller 38 without fail.

The number of vibrations in the range of 1 to 8, which is shown in the verified results, is determined on the assumption that the image forming apparatus 10 is a general image forming apparatus that is capable of processing a hundred A4-sized recording sheets P per minute.

FIG. 6C is a table showing the evaluations of smears on the back surface of the recording medium P for different numbers of prints performed by using the basic structure and the first to third additional structures in the comparative examples and the first exemplary embodiment. The mark "O" represents no smear (good), the mark "Δ" represents the presence of few smears that do not affect image quality (fair), the mark "x" represents the presence of conspicuous smears that impair the print quality (bad), and the mark "***" represents that no evaluation is made because a bad evaluation has been already made.

As shown in FIG. 6C, even in the comparative examples (in which the alternating voltage Vbtr is not applied), due to the presence of the auxiliary blade 66 or the auxiliary blade 68, the evaluation is good when the number of prints is about 15 kPV (15000 pages). However, when the number of prints is about 50 kPV (50000 pages), the evaluation is bad, that is, conspicuous toner smears are left on the back surface of the recording sheet P.

In contrast, with the first exemplary embodiment having the basic structure, the evaluation is good when the number of prints is 50 kPV or less and is fair when the number of prints is 100 kPV (100000 pages).

With the first exemplarity embodiments having any of the first to third additional structures, the evaluation is good even when the number of prints is more than 100 kPV (100000 pages).

Second Exemplary Embodiment

Hereinafter, a second exemplary embodiment will be described. Elements of the second exemplary embodiment the same as those of the first exemplary embodiment will be denoted by the same numerals and descriptions of such elements will be omitted.

In the second exemplary embodiment, the cleaning blade 62, which directly and mechanically removes toner, does not face the second-transfer roller 38. Instead, a cleaning unit that electrically removes toner is disposed between the cleaning blade 62 and the second-transfer roller 38.

Cleaning devices illustrated in FIGS. 7A to 7D are designed to be used to clean the surface of a second-transfer roller 38 having an elastic member that is exposed. In other words, the elastic member, which forms the peripheral surface of the second-transfer roller 38, is not covered with the resin film 60 of the first exemplary embodiment. Therefore, the porous elastic member is exposed, and it is difficult (or impossible) for the cleaning blade 62 to mechanically remove toner from the second-transfer roller 38.

For this reason, the second exemplary embodiment includes a cleaning belt 76 having a movement path that contacts the surface of the second-transfer roller 38.

The cleaning belt 76 is looped over a pair of rollers 78 and 80, at least one of which is rotated by a driving unit (such as a motor). Therefore, the cleaning belt 76 rotates along a loop-shaped movement path. The loop-shaped movement path has a contact point at which the cleaning belt 76 contacts the second-transfer roller 38.

To one of the pair of rollers 78 and 80 (in this example, the roller 80), a direct-current power source 82 applies a direct-current voltage having a polarity opposite to the polarity of the direct-current voltage Vbur applied to the backup roller 36. Therefore, the cleaning belt 76 is capable of electrically removing toner from the second-transfer roller 38 (and transferring the toner to the cleaning belt 76). The cleaning belt 76 and the direct-current power source 82 function as a cleaning unit that electrically removes toner.

The cleaning blade 62, which is disposed so as to be in contact with the cleaning belt 76, scrapes toner, which has been transferred to the cleaning belt 76, from the cleaning belt 76.

Figure 7A:
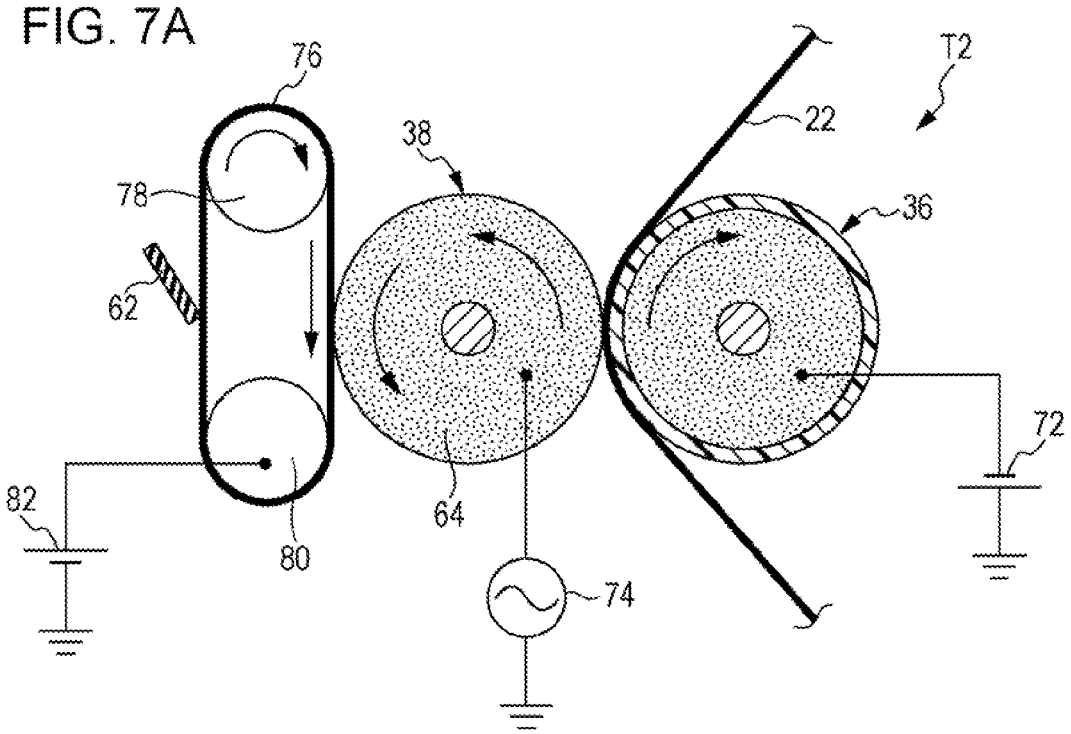
FIGS. 7A to 7D are enlarged views illustrating the structures of a second-transfer section according to a second exemplary embodiment, FIG. 7A illustrating a basic structure, FIG. 7B illustrating a first additional structure, FIG. 7C illustrating a second additional structure, and FIG. 7D illustrating a third additional structure.
Figure 7B:
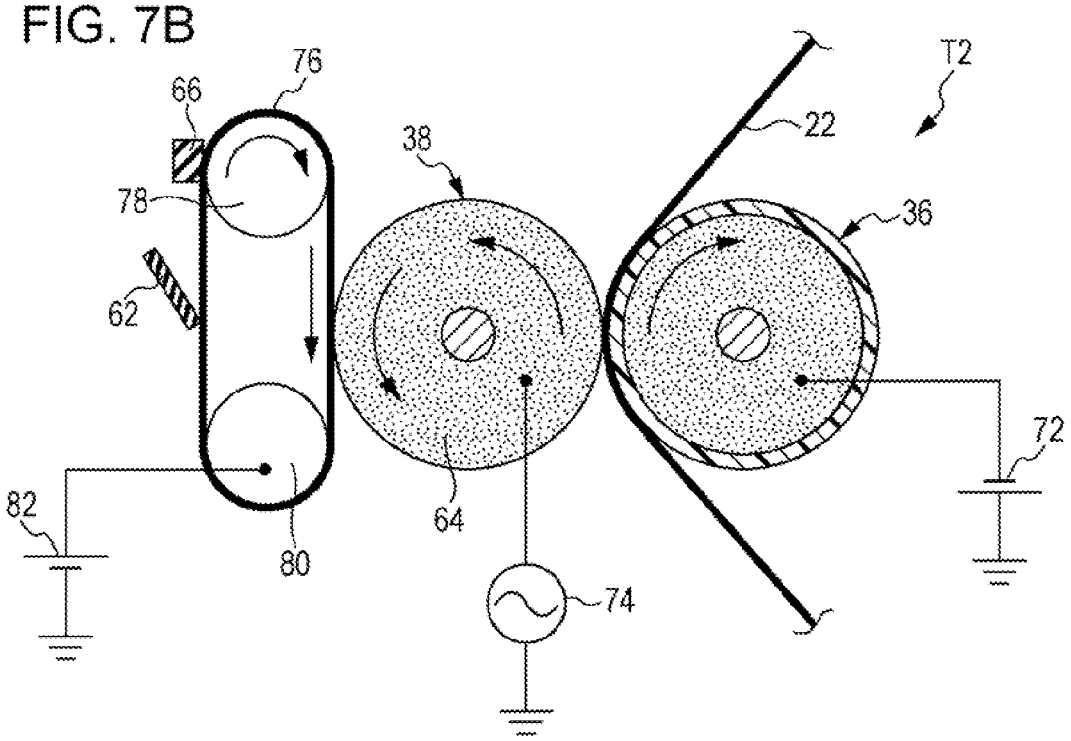
Figure 7C:
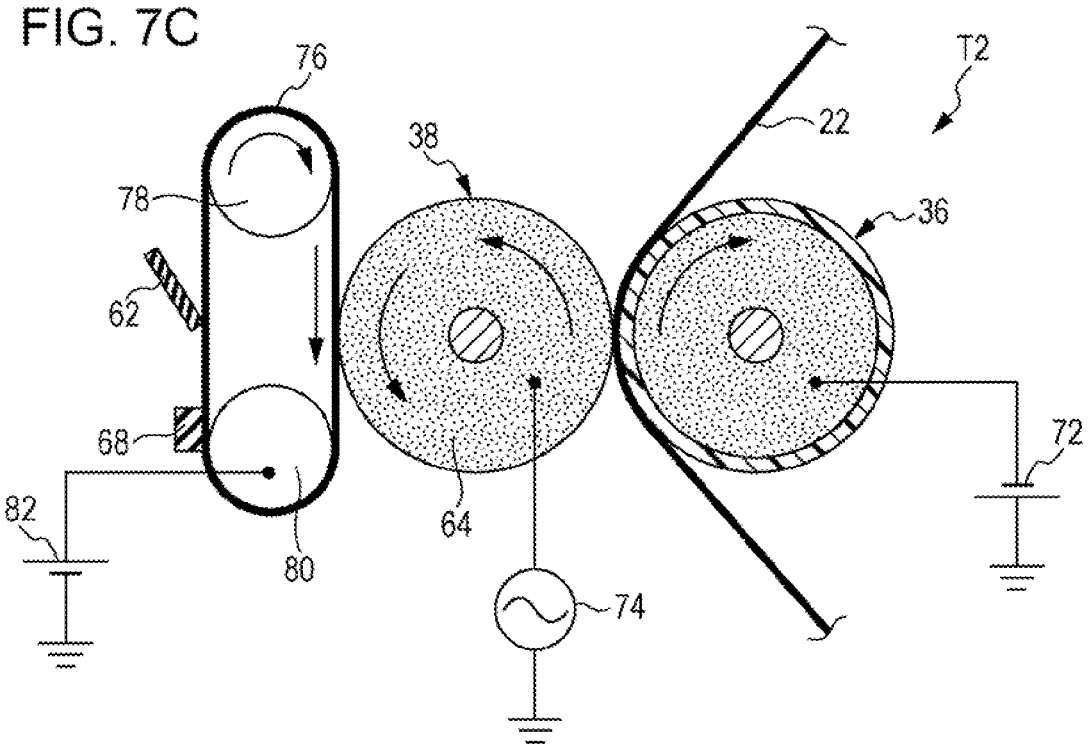
Figure 7D:
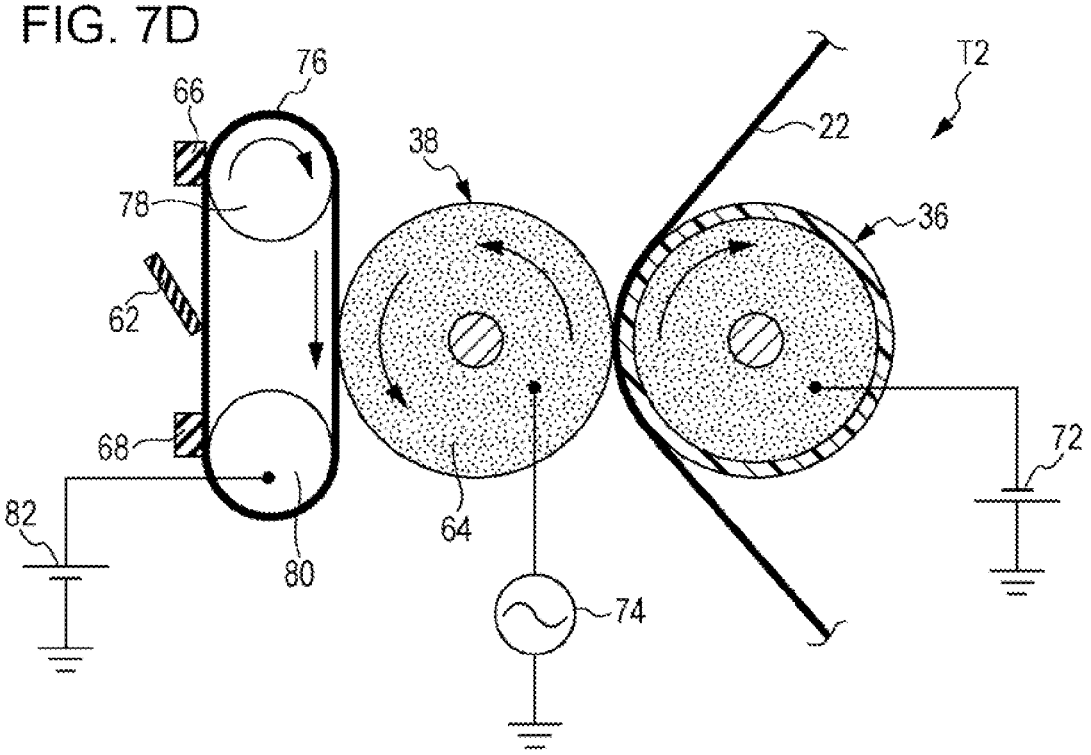

As with the first exemplary embodiment, the second exemplary embodiment may have any of the representative cleaning blade structure illustrated in FIG. 7A (basic structure) and first to third additional structures illustrated in FIGS. 7B to 7D. The first to third additional structures respectively include, in addition to the cleaning blade 62 of the basic structure, the auxiliary blade 66, the auxiliary blade 68, and both of these. First Additional Structure (Upstream Auxiliary Blade 66)

FIG. 7B illustrates a second-transfer section having a first additional structure in which, in addition to the basic structure, the auxiliary blade 66 is disposed on the upstream side of the cleaning blade 62 in the rotation direction of the cleaning belt 76.

The upstream auxiliary blade 66 functions as a pre-cleaning blade that removes toner from the cleaning belt 76 before the cleaning blade 62 removes toner from the cleaning belt 76.

The first additional structure is capable of, in addition to decreasing the force of adhesion of toner due to application of the alternating voltage Vbtr to the second-transfer roller 38, increasing the cleaning ability by removing part of toner beforehand when the amount of the toner is large.

Second Additional Structure (Downstream Auxiliary Blade 68)

FIG. 7C illustrates a second-transfer section having a second additional structure in which, in addition to the basic structure, the auxiliary blade 68 is disposed on the downstream side of the cleaning blade 62 in the rotation direction of the cleaning belt 76.

The downstream auxiliary blade 68 functions as a post-cleaning blade that removes remaining toner, which is not removed from the cleaning belt 76 by the cleaning blade 62, from the cleaning belt 76.

The second additional structure is capable of, in addition to decreasing the force of adhesion of toner due to application of the alternating voltage Vbtr to the second-transfer roller 38, increasing the cleaning ability by removing part of toner that is not removed by the cleaning blade 62.

Third Additional Structure (Upstream Auxiliary Blade 66 and Downstream Auxiliary Blade 68)

FIG. 7D illustrates a second-transfer section having a third additional structure in which, in addition to the basic structure, the auxiliary blade 66 is disposed on the upstream side of the cleaning blade 62 and the auxiliary blade 68 is disposed on the downstream side of the cleaning blade 62 in the rotation direction of the cleaning belt 76.

The upstream auxiliary blade 66 functions as a pre-cleaning blade that removes toner from the cleaning belt 76 before the cleaning blade 62 removes toner from the cleaning belt 76.

The downstream auxiliary blade 68 functions as a post-cleaning blade that removes remaining toner, which is not removed by the cleaning blade 62 and remains on the cleaning belt 76, from the cleaning belt 76.

In the second exemplary embodiment, the direct-current power source 72 applies a direct-current voltage Vbur (having the same polarity as the toner potential) to the backup roller 36. The alternating-voltage power source 74 applies an alternating voltage Vbtr to the second-transfer roller 38.

When the alternating voltage Vbtr is applied to the second-transfer roller 38, in relation to the polarity of the direct-current voltage Vbur applied to the backup roller 36, toner that is being transferred from the intermediate transfer belt 22 vibrates (reciprocates) in the nip between the intermediate transfer belt 22 and the second-transfer roller 38.

The number of vibrations (the number of reciprocations) is adjustable by changing the direct-current voltage Vbur and the alternating voltage Vbtr (predetermined frequency, duty ratio, Vpp, and Vave). In the second exemplary embodiment, the voltages Vbur and Vbtr are set so that the number of vibrations (the number of reciprocations) of toner is once or more and eight times or less (in the range of 1 to 8 times) when the toner moves in the nip width d between the intermediate transfer belt 22 and the second-transfer roller 38.

Moreover, in the second exemplary embodiment, the direct-current power source 82 applies, to the rollers 80 over which the cleaning belt 76 is looped, a direct-current voltage having a polarity opposite to the polarity of the direct-current voltage Vbur applied to the backup roller 36. Therefore, the cleaning belt 76 is capable of electrically attracting toner adhering to the second-transfer roller 38 and removing toner even if the toner has entered into recesses in the surface of the second-transfer roller 38.

The cleaning blade 66 (and the auxiliary blades 66 and 68) scrapes the toner from the cleaning belt 76.

FIG. 8 is a table showing examples of setting patterns (patterns 2-1 to 2-3) of the direct-current voltage Vcln, the alternating voltage Vbtr (the average voltage Vave), and the direct-current voltage Vbur. In any of these patterns, the average value Vave of the alternating voltage Vbtr is higher than the direct-current voltage Vbur.

The voltages are set so that the average value Vave of the alternating voltage Vbtr is between the voltages Vcln and Vbur (that is, the polarities of the voltages Vcln and Vbur are opposite to each other in effect).

The voltages are set so that toner vibrates (reciprocates) once or more in the nip between the intermediate transfer belt 22 and the second-transfer roller 38 for the following reason: when a voltage for causing toner to vibrate once is applied, the force of adhesion of the toner to the second-transfer roller 38 is reduced to a level that allows the cleaning blade 62 to scrape (remove) the toner from the second-transfer roller 38 without fail.

The voltages are set so that toner vibrates (reciprocates) eight times or less in the nip between the intermediate transfer belt 22 and the second-transfer roller 38 for the following reason: if a voltage for causing toner to vibrate more than eight times is applied, the frequency of the alternating voltage Vbtr is excessively high and the vibrations of the toner are weakened, and therefore the force of adhesion of toner to the second-transfer roller 38 becomes a level that does not allow the cleaning blade 62 to scrape off (remove) the toner without fail.

Figure 9A:
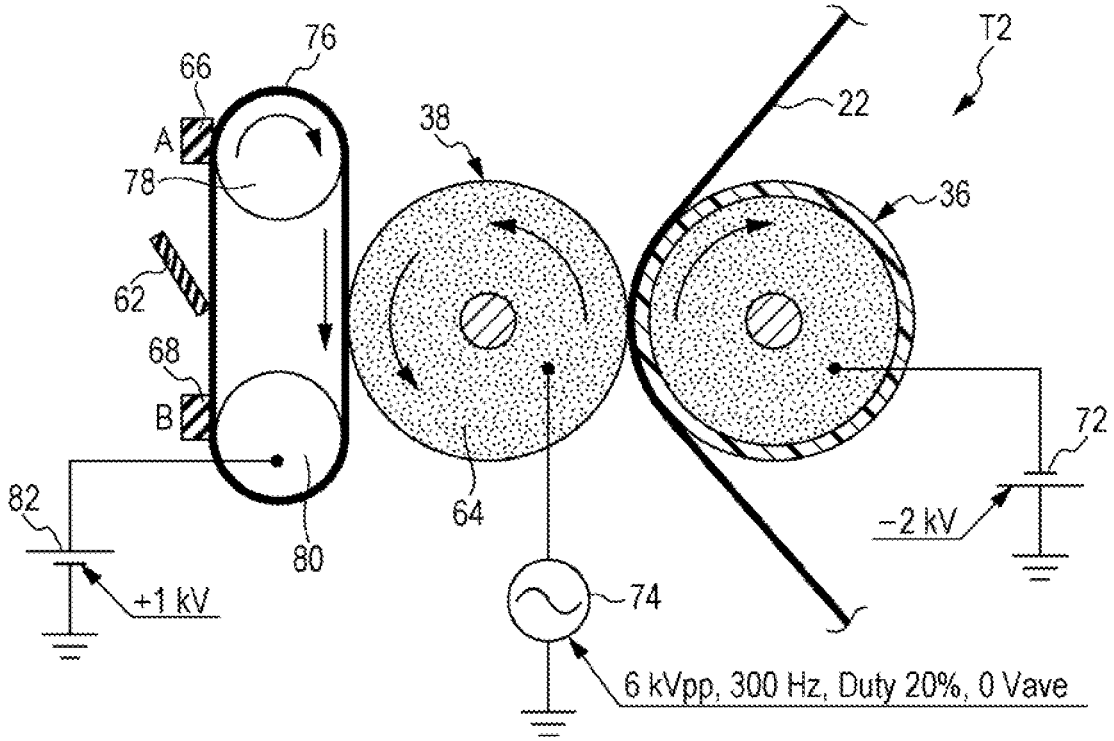
FIGS. 9A to 9C illustrate an exemplary experiment performed to examine the occurrence of toner smears in the second-transfer section according to the second exemplary embodiment, FIG. 9A showing an enlarged view of the second-transfer section having an experimental structure and showing evaluation conditions, FIG. 9B showing evaluations of smears in the second-transfer section for different numbers of vibrations, and FIG. 9C showing evaluations of smears for different numbers of prints and for various structures that the second exemplary embodiment, including comparative examples, may have.
Figures 9B, 9C:
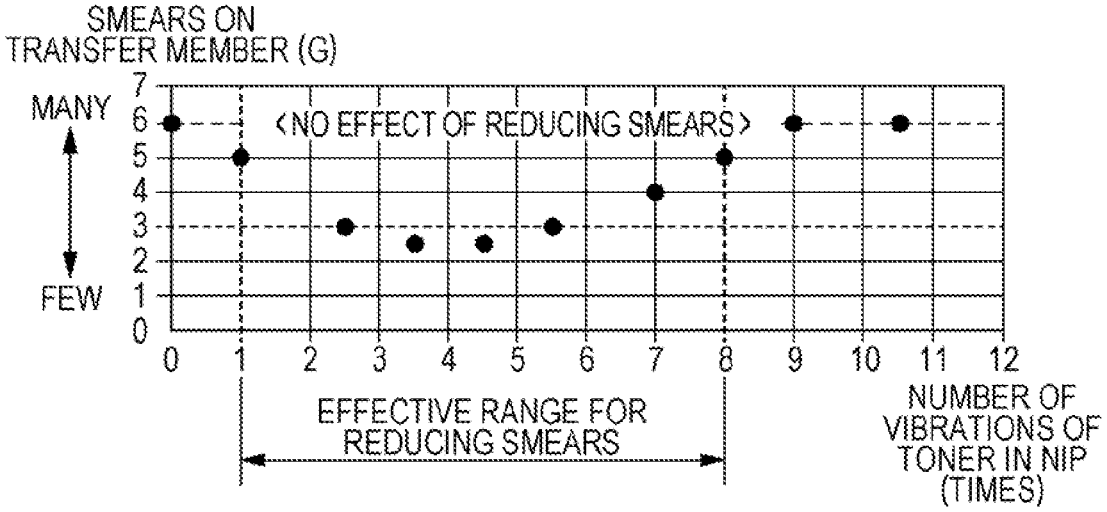
Figure 10A:
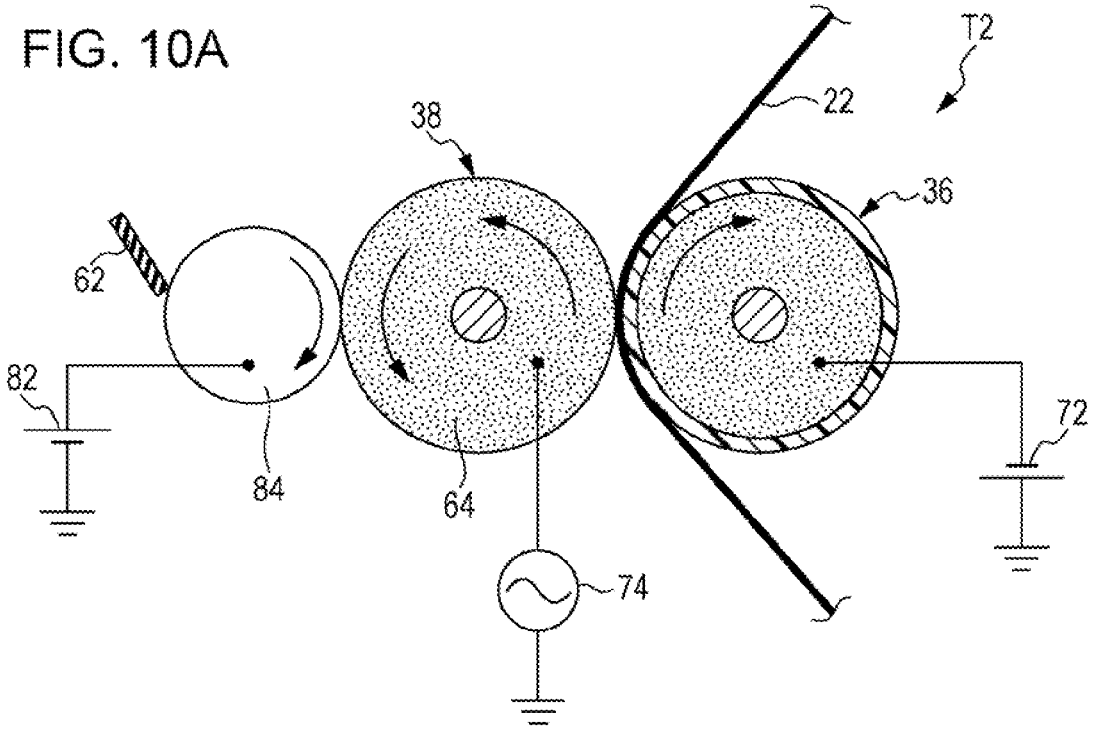
FIGS. 10A to 10D are enlarged views illustrating the structures of a second-transfer section according to a modification of the second exemplary embodiment, FIG. 10A illustrating a basic structure, FIG. 10B illustrating a first additional structure, FIG. 10C illustrating a second additional structure, and FIG. 10D illustrating a third additional structure.
Figure 10B:
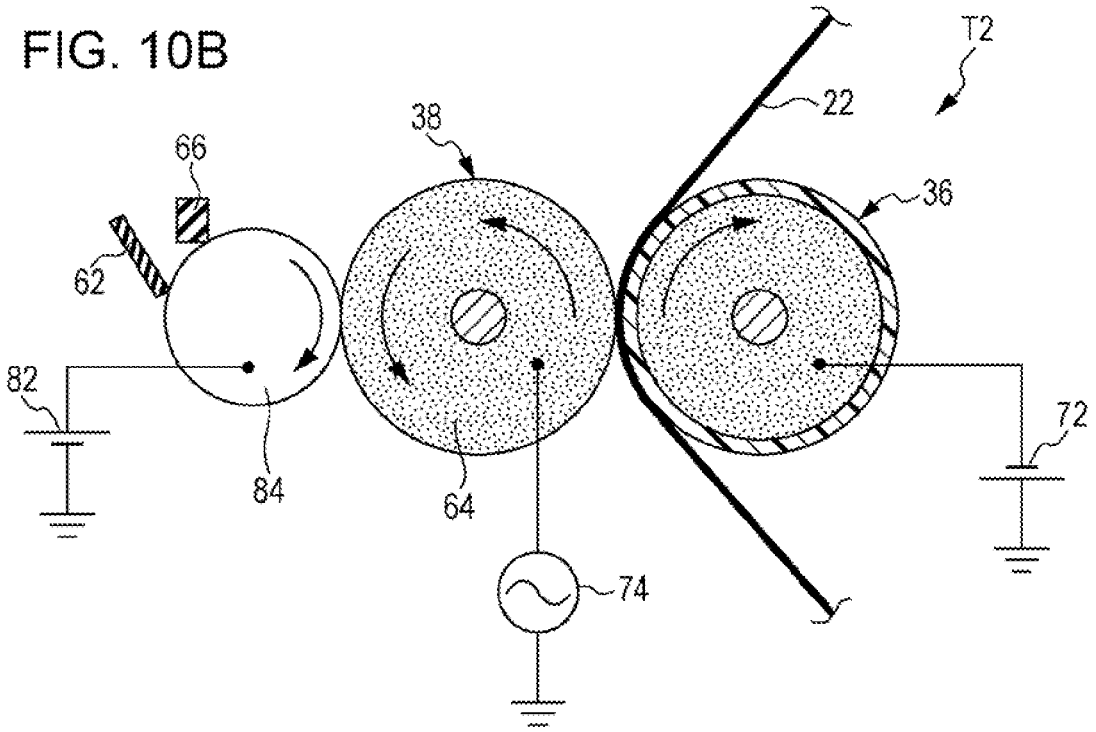
Figure 10C:
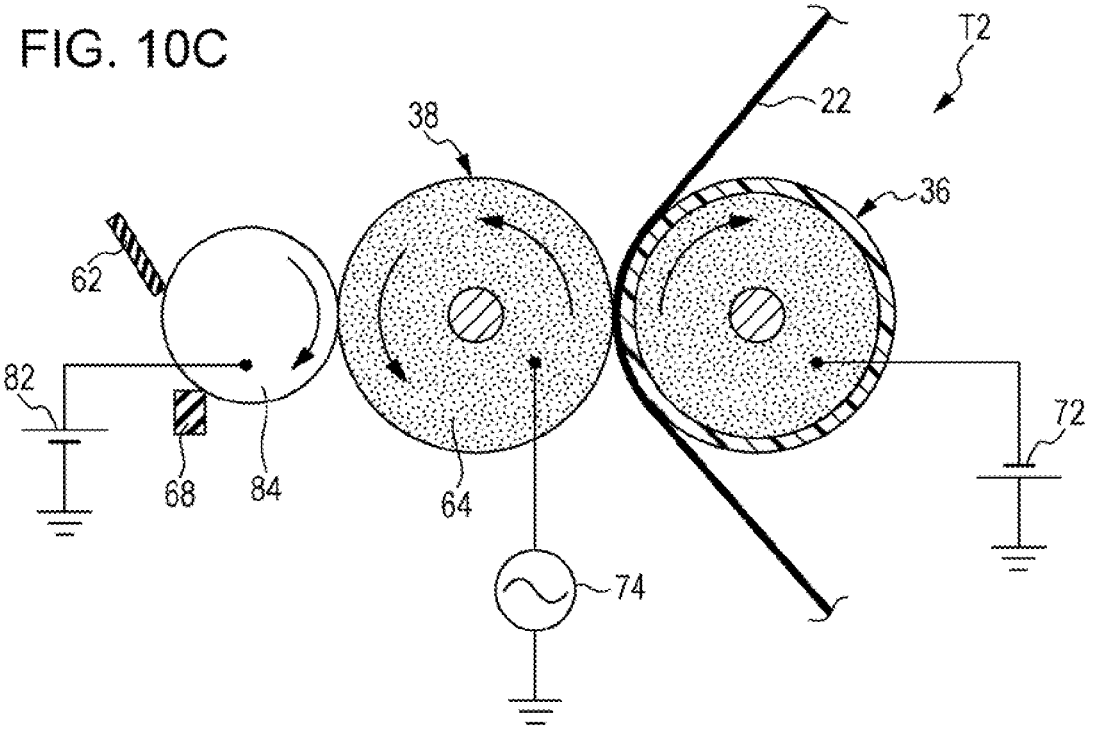
Figure 10D:
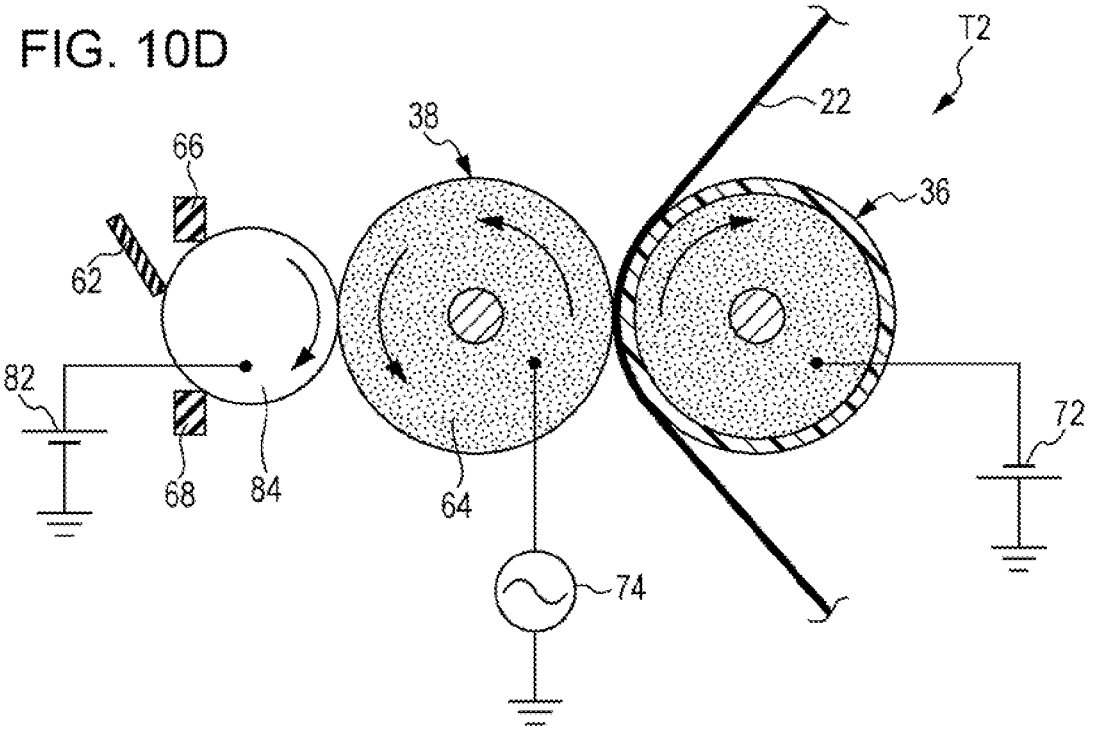

FIGS. 9A to 9C show an example in which toner smear on the back surface of a recording medium P corresponding to the number of prints is evaluated in a case where the alternating voltage Vbtr is applied to the second-transfer section (the second exemplary embodiment) and in a case where the alternating voltage Vbtr is not applied to the second-transfer section (comparative examples). The second-transfer section has one of the basic structure and first to third additional structures shown in FIGS. 7A to 7D.

FIG. 9A illustrates the structure of the second-transfer section T2, in which the upstream auxiliary blade 66 ("A") and the downstream auxiliary blade 68 ("B") are removable. That is, the second-transfer section T2 shown in FIG. 7A, which is designed for an experiment, is capable of having any of the basic structure and the first-second additional structures.

Evaluation is performed under the following preconditions: the direct-current voltage Vbur is −2 kV; and the alternating voltage Vbtr has a frequency of 300 Hz, a duty ratio of 20%, an amplitude voltage Vpp of 12 kV, and an average voltage Vave of 0 kV. The direct-current voltage Vcln is +3 kV.

Evaluation conditions are as follows: a negatively charged toner is used, the recording sheets P are A4-sized Ncolor209 sheets (each having the same thickness as a standard postcard), the applied amount of toner is 7.5 g/m$^2$, and the image size is 214 mm×301 mm (2 mm larger than each of the long side and a short side of the A4-sized recording sheet P).

FIG. 9B is a characteristic graph showing the relationship between smears (G) on the transfer member (the second-transfer roller 38) and the number vibrations (reciprocations) of toner in the nip between the intermediate transfer belt 22 and the second-transfer roller 38. The lower the G-value, the fewer the smears. When the G-value is 5 or lower, it is evaluated that a smear reducing effect is produced.

As shown in FIG. 9B, when the number of vibrations is zero, that is, when toner is removed by using only the cleaning blade 62, the G-value is 6, indicating that a smear reducing effect is not produced. When the number of vibrations is nine times or more, the G-value is 6, indicating that a smear reducing effect is not produced.

Thus, the following results are verified.

Verified Result 1

When toner vibrates (reciprocates) in the nip between the intermediate transfer belt 22 and the second-transfer roller 38 once or more, the force of adhesion of the toner to the second-transfer roller 38 is reduced to a level that allows the cleaning blade 62 to remove (scape) the toner from the second-transfer roller 38 without fail.

Verified Result 2

When the number of times toner vibrates (reciprocates) in the nip between the intermediate transfer belt 22 and the second-transfer roller 38 is eight or more, the frequency of the alternating voltage Vbtr is excessively high and the vibrations of the toner are weakened, so that the force of adhesion of toner to the second-transfer roller 38 becomes a level that does not allow the cleaning blade 62 to scrape (remove) from the second-transfer roller 38 without fail.

The number of vibrations in the range of 1 to 8, which is shown in the verified results, is determined on the assumption that the image forming apparatus 10 is a general image forming apparatus that is capable of processing a hundred A4-sized recording sheets P per minute.

FIG. 9C is a table showing the evaluations of smears on the back surface of the recording medium P for different numbers of prints performed by using the basic structure and the first to third additional structures in the comparative examples and the second exemplary embodiment. The mark "O" represents no smear (good), the mark "Δ" represents the presence of few smears that do not affect image quality (fair), the mark "x" represents the presence of conspicuous smears that impair the print quality (bad), and the mark "***" represents that no evaluation is made because a bad evaluation has been already made.

As shown in FIG. 9C, in the comparative examples (in which the alternating voltage Vbtr is not applied), irrespective of the presence/absence of the auxiliary blade 66 or the auxiliary blade 68, toner smears are left on the back surface of the recording medium P from the initial state (the first sheet).

It is considered that this is because the porous elastic member 64 of the second-transfer roller 38 is exposed and toner enters recesses in the surface of the elastic member 64.

Next, as a comparative example of the basic structure, when the direct-current voltage Vcln of −1 kV, which has the same polarity as the direct-current voltage Vbur applied to the backup roller 36, is applied to the cleaning belt 76, toner smears are left on the back surface of a recording medium P from the initial state (the first sheet). It is considered that, when the polarities are the same, the function of transferring toner is not performed.

In contrast, with the second exemplary embodiment having the basic structure in which a direct-current voltage Vcln of +3 kV, which has a polarity opposite to the polarity of the direct-current voltage Vbur applied to the backup roller 36, is applied to the cleaning belt 76, the evaluation is good when the number of prints is 50 kPV or less and is fair even when the number of prints is 100 kPV (100000 pages).

With the second exemplarity embodiments having any of the first to third additional structures, the evaluation is good even when the number of prints is more than 100 kPV (100000 pages).

With the second exemplary embodiment, even though the porous elastic member 64 of the second-transfer roller 38 is exposed, by electrically removing toner with the cleaning belt 76, it is possible to sufficiently produce the effect of application of the alternating voltage Vbtr to the second-transfer roller 38, which is the basic feature.

In the second exemplary embodiment, the cleaning belt 76 is used to electrically remove toner from the second-transfer roller 38. As shown in FIGS. 10A to 10D, a cleaning roller 84 may be used instead of the cleaning belt 76.

In addition to the cleaning belt 76 or the cleaning roller 84, another blade for mechanically scraping toner from the second-transfer roller 38 may be used. In this case, the other blade is used to scrape off toner roughly, and the cleaning belt 76 or the cleaning roller 84 may be used to remove toner delicately.

The structures shown in FIGS. 10A to 10D respectively differ from those of FIGS. 7A to 7D in that the cleaning belt 76 is replaced with the cleaning roller 84. In other respects, the structures shown in FIGS. 10A to 10D are the same as those shown in FIGS. 7A to 7D. Therefore, detailed descriptions of these structures will be omitted. In evaluating these structures, evaluations the same as those shown in FIG. 9C are obtained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer unit including an image carrier that carries a toner image to be transferred to a transfer surface of a recording medium, a transfer member disposed on a non-transfer-surface side of the recording medium, and an opposing member disposed opposite the transfer member with the image carrier therebetween;

a cleaning unit that cleans a surface of the transfer member;

a first application unit that applies a voltage, for transferring the toner image, to the opposing member; and a second application unit that applies an alternating voltage to the transfer member, an average value of the alternating voltage applied by the second application unit being higher than the voltage applied by the first application unit.

2. The transfer device according to claim 1, wherein a polarity of the alternating voltage alternates with respect to a voltage of toner that is positively or negatively charged.

3. The transfer device according to claim 1, wherein the transfer member includes a roller body made of an elastic material, and a resin film that covers a periphery of the roller body, that has a hardness lower than a hardness of the opposing member, and that has a surface roughness Rz of 0.2 μm or less, and wherein the cleaning unit includes a scraping member that mechanically scrapes adhering matter, including toner, from the resin film on the surface of the transfer member by directly contacting the resin film.

4. The transfer device according to claim 2, wherein the transfer member includes a roller body made of an elastic material, and a resin film that covers a periphery of the roller body, that has a hardness lower than a hardness of the opposing member, and that has a surface roughness Rz of 0.2 μm or less, and wherein the cleaning unit includes a scraping member that mechanically scrapes adhering matter, including toner, from the resin film on the surface of the transfer member by directly contacting the resin film.

5. The transfer device according to claim 1, wherein the cleaning unit includes a cleaning member that electrically removes adhering matter, including toner, from the transfer member by using a voltage applied thereto, the voltage having a polarity opposite to a polarity of an average voltage of the alternating voltage applied by the second application unit, and a scraping member that mechanically scrapes the adhering matter from a surface of the cleaning member by directly contacting the surface.

6. The transfer device according to claim 2, wherein the cleaning unit includes a cleaning member that electrically removes adhering matter, including toner, from the transfer member by using a voltage applied thereto, the voltage having a polarity opposite to a polarity of an average voltage of the alternating voltage applied by the second application unit, and a scraping member that mechanically scrapes the adhering matter from a surface of the cleaning member by directly contacting the surface.

7. The transfer device according to claim 3, further comprising:

an auxiliary scraping member disposed on at least one of an upstream side and a downstream side of a position of the scraping member in a movement direction of a surface from which the adhering matter is to be scraped.

8. The transfer device according to claim 4, further comprising:

an auxiliary scraping member disposed on at least one of an upstream side and a downstream side of a position of the scraping member in a movement direction of a surface from which the adhering matter is to be scraped.

9. The transfer device according to claim 5, further comprising:

an auxiliary scraping member disposed on at least one of an upstream side and a downstream side of a position of the scraping member in a movement direction of a surface from which the adhering matter is to be scraped.

10. The transfer device according to claim 6, further comprising:

an auxiliary scraping member disposed on at least one of an upstream side and a downstream side of a position of the scraping member in a movement direction of a surface from which the adhering matter is to be scraped.

11. The transfer device according to claim 1, wherein a frequency of the alternating voltage applied by the second application unit is set so that the number of vibrations of toner in a nip between the image carrier and the transfer member is in a range of 1 to 8.

12. The transfer device according to claim 11, wherein the number of vibrations is determined by the frequency of the alternating voltage applied by the second application unit, the frequency being represented as follows:

$$f=(n/d)\times v(\mathrm{Hz}),$$

where f is the frequency; n is the number of vibrations; d is a width of the nip between the image carrier and the transfer member, which is a vibration range; and v is a movement velocity of the transfer member in the width of the nip.

13. An image forming apparatus comprising:

transfer device according to claim 1;

a photoconductor on which an electrostatic latent image is formed in accordance with image data; and a developing unit that forms a toner image by developing the electrostatic latent image formed on the photoconductor, wherein the transfer device functions as a second-transfer section that transfers the toner image, which has been first-transferred to the image carrier, to the recording medium.

* * * * *